United States Patent [19]

Ottenstein et al.

[11] 4,109,777

[45] Aug. 29, 1978

[54] TICKET PRINTER

[75] Inventors: Allan S. Ottenstein; John A. Callahan, both of Houston, Tex.

[73] Assignee: Research Fuels, Inc., Houston, Tex.

[21] Appl. No.: 710,712

[22] Filed: Aug. 2, 1976

[51] Int. Cl.[2] ..... B41J 7/70

[52] U.S. Cl. ..... 400/124; 364/900; 101/93.05; 400/76

[58] Field of Search ..... 197/1 R; 101/93.05, 101/93.04; 172/23 R, 233; 340/172.5; 364/900

[56] References Cited

U.S. PATENT DOCUMENTS

| | | | |
|---|---|---|---|
| 2,997,152 | 8/1961 | Dirks | 197/1 R |
| 3,869,986 | 3/1975 | Hubbard | 101/91 |
| 3,892,174 | 7/1975 | Marcher | 197/1 R X |
| 3,923,135 | 12/1975 | Holman et al. | 197/1 R |
| 3,942,620 | 3/1976 | Dillinger et al. | 101/93.05 X |
| 3,970,184 | 7/1976 | Helmrich et al. | 197/1 R |

*Primary Examiner*—Edward M. Coven
*Attorney, Agent, or Firm*—Donald Gunn

[57] ABSTRACT

A ticket printer is disclosed. A motor equipped with a centrifical speed governor, opposing ticket rollers and ticket transport tray rolls a blank, multipage ticket form past seven needle printing heads which are solenoid actuated and two sequencing switches. The ticket to be printed is inserted into the ticket transport tray and engages a motor operate switch which rotates certain ticket rollers at a governed speed. The ticket advances, pinched by opposing rollers and moves beneath the seven parallel needle printing heads and also actuates a print start switch which initiates electronic operation. The ticket continues its advance while being printed for N digits until the ticket disengages the motor start switch whereupon the drive motor rotates sufficiently to expel the ticket from the tray and printer. The apparatus accepts N digits of BCD formated data in serial fashion. This data is stored temporarily in the register, and is called sequentially by a multiplexer connected to a four line input into a BCD to seven segment decoder. The seven segment signals are output to a (X by Y) seven by five matrix which forms drive signals for dot keyers connected to seven solenoids. The solenoids are momentarily actuated to form a dot. They are actuated potentially five times during the advance of the ticket form to place each digit on the ticket form on a seven by five dot pattern.

6 Claims, 9 Drawing Figures

TICKET PRINTER

BACKGROUND OF THE INVENTION

For cash registers and the like it is necessary to form an internal record, particularly where data processing equipment is used with the cash register. It is often highly desirable to form a printed ticket to be dispensed with the goods, and typically they must be printed in multiple copies. For instance, one copy can be given to the customer, another copy retained by the sales clerk for purposes of calculating his commissions, and another ticket turned in with the cash register receipts at the end of the day to enable balancing of the cash register with the actual cash receipts.

It is possible to utilize straight alphanumeric characters in the form of type written characters. However, this requires an unduly complex press head. A print head the numeric characters only is relatively simplified by it still requires a type of rotating wheel or typing keys. The present invention is directed to an alternate construction which is believed to be simplified in that every number is converted to a dot matrix, and the most convenient matrix for the present invention is a seven by five dot pattern. This takes advantage of design techniques already known including BCD formatted data which is converted to a format utilizing seven segments. Seven segment formats are known for LED displays and they are incorporated in the present apparatus. The apparatus utilizes seven parallel needle printers driven by solenoids. The seven solenoids operate in timed sequence with signals provided through a dot keyer which amplifies a driving signal from a seven by five matrix gate arrangement. The present invention is advantageous in operation in that it is able to strike quite hard using needle printer mechanisms. It is able to strike hard and therefore print through multiple copies using impact paper. Moreover, it forms characters which are easily read. Accordingly, the apparatus is advantageous in the formation of numeric characters on a ticket.

SUMMARY OF THE DISCLOSURE

The apparatus of the present disclosure is a numeric ticket printer. It utilizes a regulated motor having a governer, a ticket transport tray, opposing rollers which accept a multi-sheet ticket made of impact paper and a motor start switch which detects the presence of the ticket. The ticket is advanced past seven parallel needle printing heads driven by solenoids. An electronic circuit converts N digits of BCD data into seven segments which are then decoded by a matrix for driving the needle printing heads. N digit register for storing BCD formatted data which is connected to a multiplexer feeding the digits in a desired order through four lines to a seven segment decoder connected to a seven by five gate matrix. The gates convert the seven segment signals into dot signals which are in turn applied to the needle printers.

DESCRIPTION OF THE PREFERRED EMBODIMENT

Figure 1:
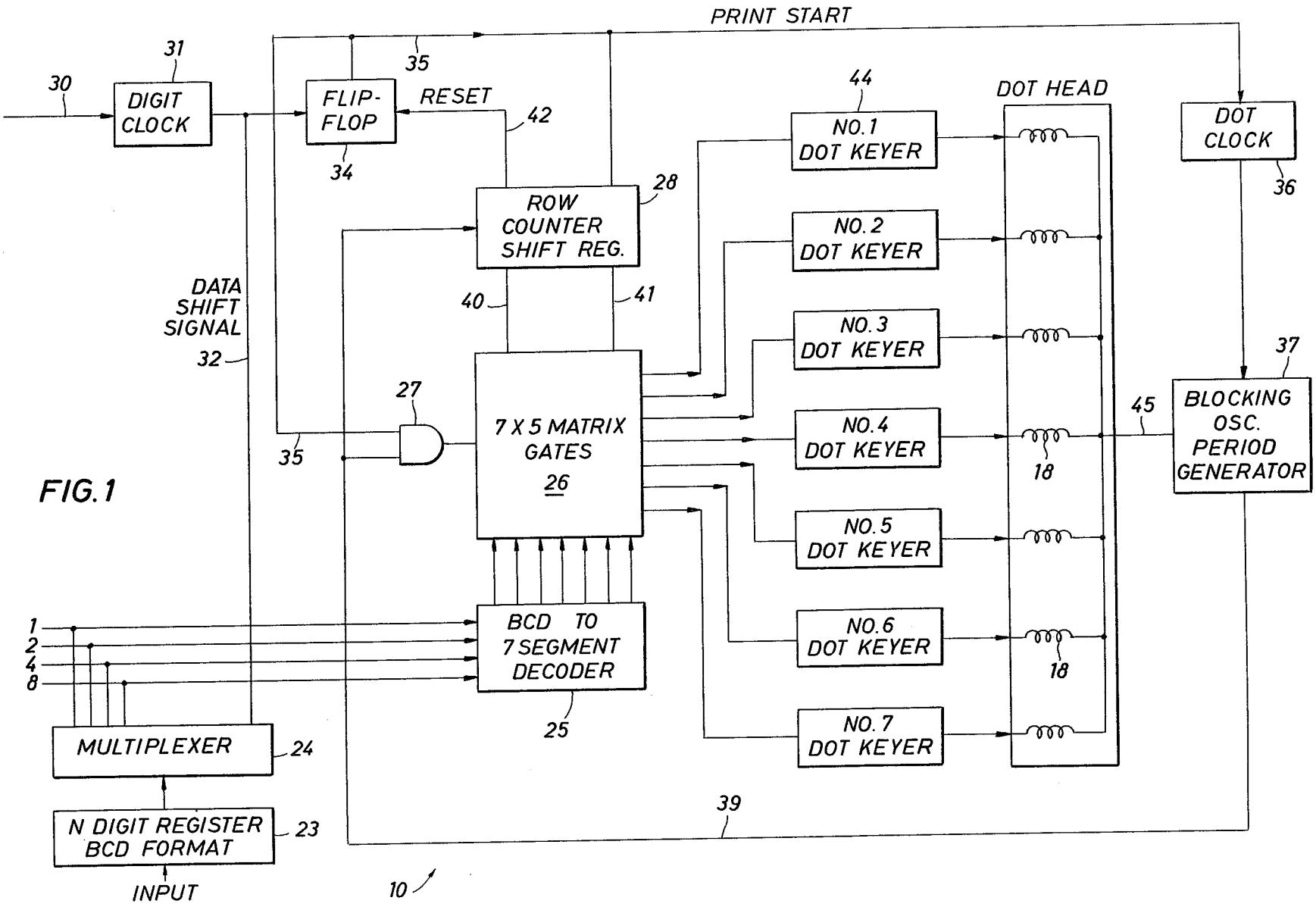
FIG. 1 is a schematic blocked diagram of the electronic equipment.
Figure 2:
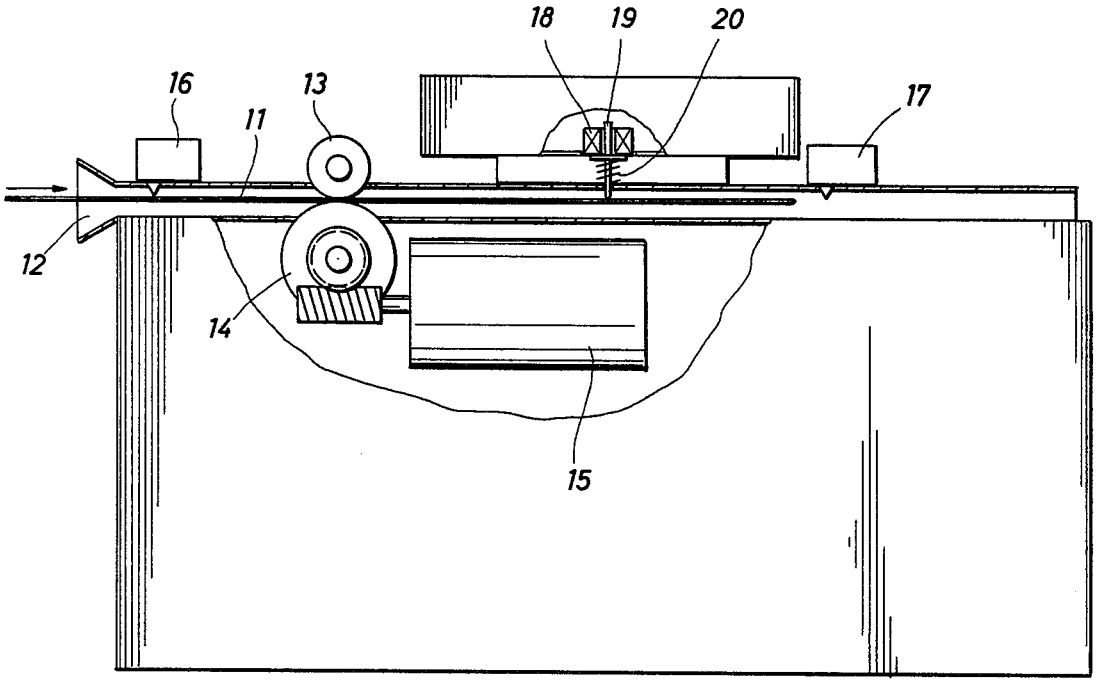
FIG. 2 discloses the ticket transport mechanism showing the position of the needle printing head and the ticket which is transported through a ticket tray.

In FIG. 1 of the drawings, the numeral 10 identifies the printing apparatus of the present disclosure. Briefly, it cooperates with a ticket 11 (see FIG. 2) which is a single piece of paper or multiple layers of paper with impact coating to provide multiple copies. For printing the ticket, the apparatus utilizes a tray 12 which receives and guides the ticket as it is inserted. The ticket travels between a pair of rollers, an idler roller being indicated by the numeral 13 and located oppositely of a drive roller 14. The drive roller rotates and forces the ticket through the printer mechanism of FIG. 2. The drive roller 14 is connected to a governed motor 15. The motor 15 is selectively switched off and on. The ticket engages a motor start switch 16 which starts the ticket roller 14 in action. After the ticket is advanced into the tray under power from the motor 15, it passes a second switch 17. The switch 17 forms a print signal which initiates the sequence of signals necessary to complete the printing. The printing itself is carried out by a solenoid 18 which is provided with a timed signal and which operates in response to the signal. The solenoid powers a needle hammer 19. The hammer is returned to its original position by a return spring 20. The solenoid is duplicated. Preferably, seven are used and they are aligned evenly with one another in a single row. More will be noted about this hereinafter.

Figure 3:
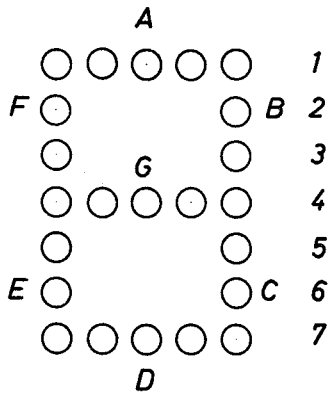
FIG. 3 represents the dot pattern for the 10 numeric values.

Attention is directed to FIG. 3 of the drawings. In FIG. 3, it will be observed that the form of the numeral is a seven by five matrix formed with dots. This arrangement of X times Y is probably one of the more popular dot patterns. Different dot patterns can be used. An economy of equipment is achieved typically with a seven by five dot matrix. Fewer dots are difficult to read and a greater number of dots requires more equipment. As shown in FIG. 3, the dot pattern is made up of seven segments which are identified by the letters affixed to the nearby segments. It will be observed that the segments are lettered sequentially beginning at the top cross bar and proceeding clockwise around the periphery. The two long sides are divided into two segments. There is a degree of ambiguity for the dots at the right and left end of the central cross bar, those shown in the fourth row. Thus the right hand dot is a member of segments B and C while the left hand dot is a portion of the segments E and F.

The dots are located a specified distance from one another. This is a scale factor and can be altered to change the relative size of the numbers formed with the dots.

Going back to FIG. 1 of the drawings, in FIG. 1, the numeral 23 identifies a multidigit register which stores digital values in a BCD format. They are input from some suitable source. After they have been input, they are stored momentarily and they are taken from the register 23 in some sequence by a multiplexer 24. The multiplexer scans the register 23 and outputs the data in the form of four bits to form the necessary value. To the extent that it is available, a fifth bit can be incorporated to encode a parity bit; however, this is being ignored for the moment so that a description may proceed of the essential equipment found in the apparatus.

The multiplexer 24 inputs the data to a decoder 25. The decoder 25 converts from BCD to seven segments signals the value input. The decoder 25 is a diode or gate matrix which makes the necessary conversion for each digit introduced to it.

The decoder 25 is connected to a dot conversion matrix 26. The matrix 26 is formed of a plurality of gates as will be described. Its operation is timed by an enable gate 27 which is periodically gated to control the sequence of the dots. The apparatus converts the seven segment input to it into dots in five rows. The number of rows can be varied; the preferred embodiment utilizes five rows. A row counting shift register 28 has inputs for signaling the occurrence of the first and fifth rows. The occurrence of the first row is the beginning of the character in question and the fifth row indicates the end of the character in question.

Figure 8:
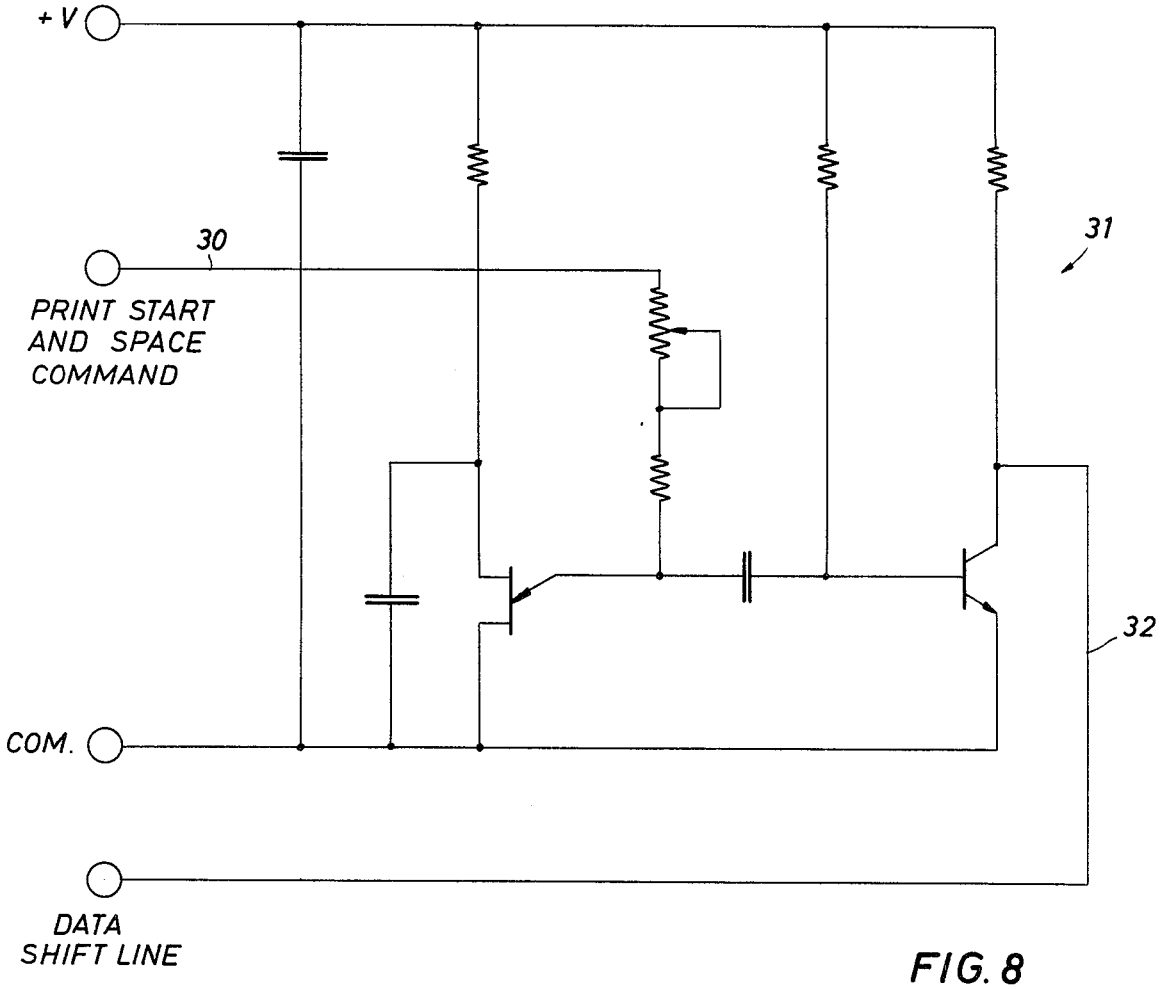
FIG. 8 discloses a schematic diagram for a digit clock.

A conductor 30 is connected with the switch 17. This serves as a print command indicating that the paper is appropriately positioned. With paper in position, the switch 17 is actuated and a signal is formed on the conductor 30 from the switch 17 which is input to a digital clock 31. The clock 31 is better shown in FIG. 8 of the drawings. It has a single output conductor 32. The conductor 32 extends to the multiplexer 24 and cues or signals the multiplexer 24 at the correct interval to cause it to transfer a numeric value. The conductor 32 is also input to a flip flop 34 which forms a set and reset signal on a conductor 35. The signal which is formed on the conductor 35 is a significant timing signal for operation of the apparatus. The signal is supplied to a dot clock 36. The dot clock forms timed pulses which are supplied to a blocking oscillator 37 and which operates as will be described. The blocking oscillator forms an output on the conductor 39 which is an enable signal supplied to the gate 27. The conductor 35 is also input to the gate. When the two signals coincide, the AND gate 27 forms a dot input. This will be described when the gates are considered in detail.

The conductor 35 is also input to the shift register 28. The shift register 28 forms signals timed with the first row and the last row of a given digit, and these are input to the gates 26 via conductors 40 and 41. It forms an end of operation signal on the conductor 42 which is the second signal input to the flip flop 34. The flip flop is thus set by the signal on the conductor 32 and reset by the signal on the conductor 42.

Figure 7:
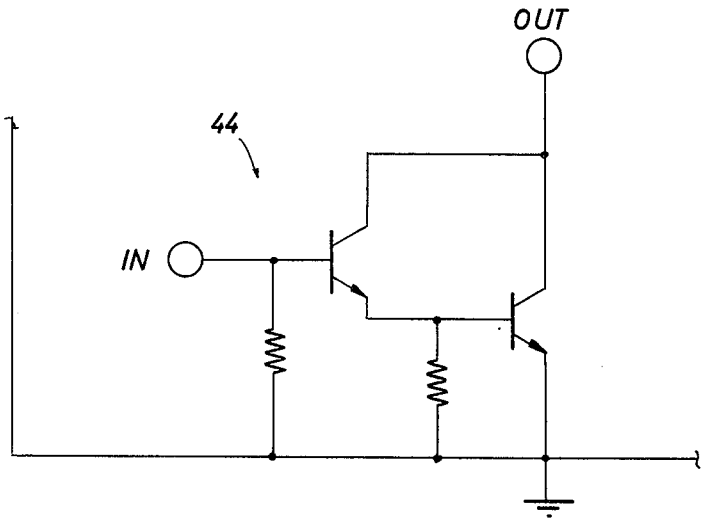
FIG. 7 shows a dot keyer.

The gates 26 collectively drive a plurality of dot keyers 44. In FIG. 7, a dot keyer 44 is illustrated and it will be observed that it is a heavy duty electronic switch which is electively switched off and on.

There are seven dot keyers. They are pulsed periodically. Each one functions as an electronic switch.

The blocking oscillator 37 selectively switches a high voltage to a conductor 45. The conductor is connected in parallel to several solenoids 18. Each solenoid is then connected to an appropriate dot keyer 44 which functions as an electronic switch providing a ground, on printing, which enables the solenoid for operation to form a dot. The solenoids are operated for a short interval, typically about millisecond or less.

Figure 4:
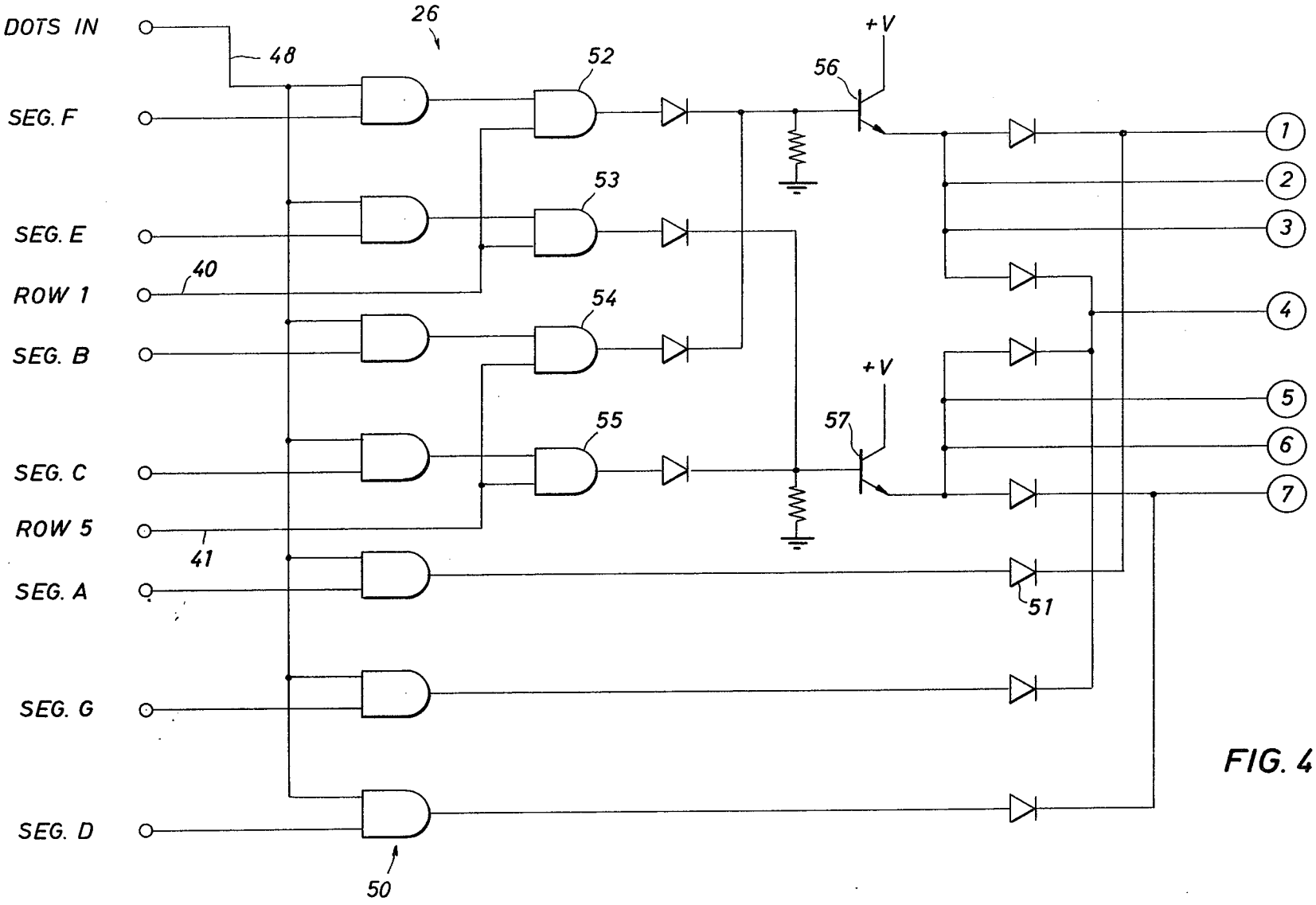
FIG. 4 is a schematic diagram of the matrix of gates which convert the seven segment signals into dots in a X by Y pattern.

The decoder 25 is typically available as an integrated circuit. For an understanding of the gates 26, attention is momentarily directed to FIG. 4 of the drawings. In FIG. 4, the numeral 48 identifies a conductor from the gate 27. This serves as an enable signal. The enable conductor 48 is input to seven gates. Each of the seven segment conductors from the decoder 25 is connected to the respective gates provided for them. The seven input signals are thus gated off and on as required and more importantly, they are broken into a dot pattern, in particular referring to the A,D, and G segments. As will be understood, if all seven signal segments are activated, the dots form a pattern for the numeral "8" as shown in FIG. 3.

Each of the seven segments A–G, is thus input to an enabled gate 50. The gates 50 form dot pulses in timed sequence subject to control of the signal on the conductor 48. The segments A, B, and G occur over a time span of five dots. They form five consecutive dots dependent on the dots signals on the conductor 48. Thus, the enabled gate 50 for segments A, G, and D is connected to a blocking diode 51, and they connect respectively to the first, fourth, and seventh rows. By contrast, the segments E and F form several dots simultaneously. Thus, the output of the gate 50 for segments E and F is then input to additional gates 52 and 53 which are both provided with the first row signal on the conductor 40 which serves as an enable pulse, and the gate 52 and 53 are enabled in timely fashion.

The segments B and C form several dots simultaneously. The conductor 41 which is input from the shift register 28 is connected to the gates 54 and 55. They are enabled during the fifth dot.

The gate 52–55 form dots for all of the rows. Thus, the gates 52 and 54 form output pulses which are summed at an amplifier transistor 56. They gate the transistor 56 on, and it is connected to the first, second, third and fourth output. The second and third outputs are driven only by the transistor 56. The first output is driven by the A segment, the B segment, and the F segment. The second and third dots are driven solely by the amplifier 56. The amplifier 56 drives the fourth dot generator but it is also driven by the G segment gate. The gates 53 and 55 are connected to appropriate blocking diodes to a amplifier transistor 57 which drives the fourth, fifth, sixth, and seventh dot generators. As shown in FIG. 4, the fifth and sixth dots are formed solely from signals to the amplifier 57. The seventh dot is formed by signals through the amplifier 57 (segments C, D, or E.) The fourth dot position is driven by any of the five segments B, C, E, F, or G.

The seven outputs are provided on conductors through a keyer circuit 44 (FIG. 7) which is an electronic switch to ground, and which grounds the solenoid 18 connected to it to complete a circuit for current flow through that solenoid.

The digit clock 31 (FIG. 8) forms a relatively short pulse which triggers operation to transfer a single digit through the equipment. It forms a relatively short pulse on the conductor 32.

Figure 5:
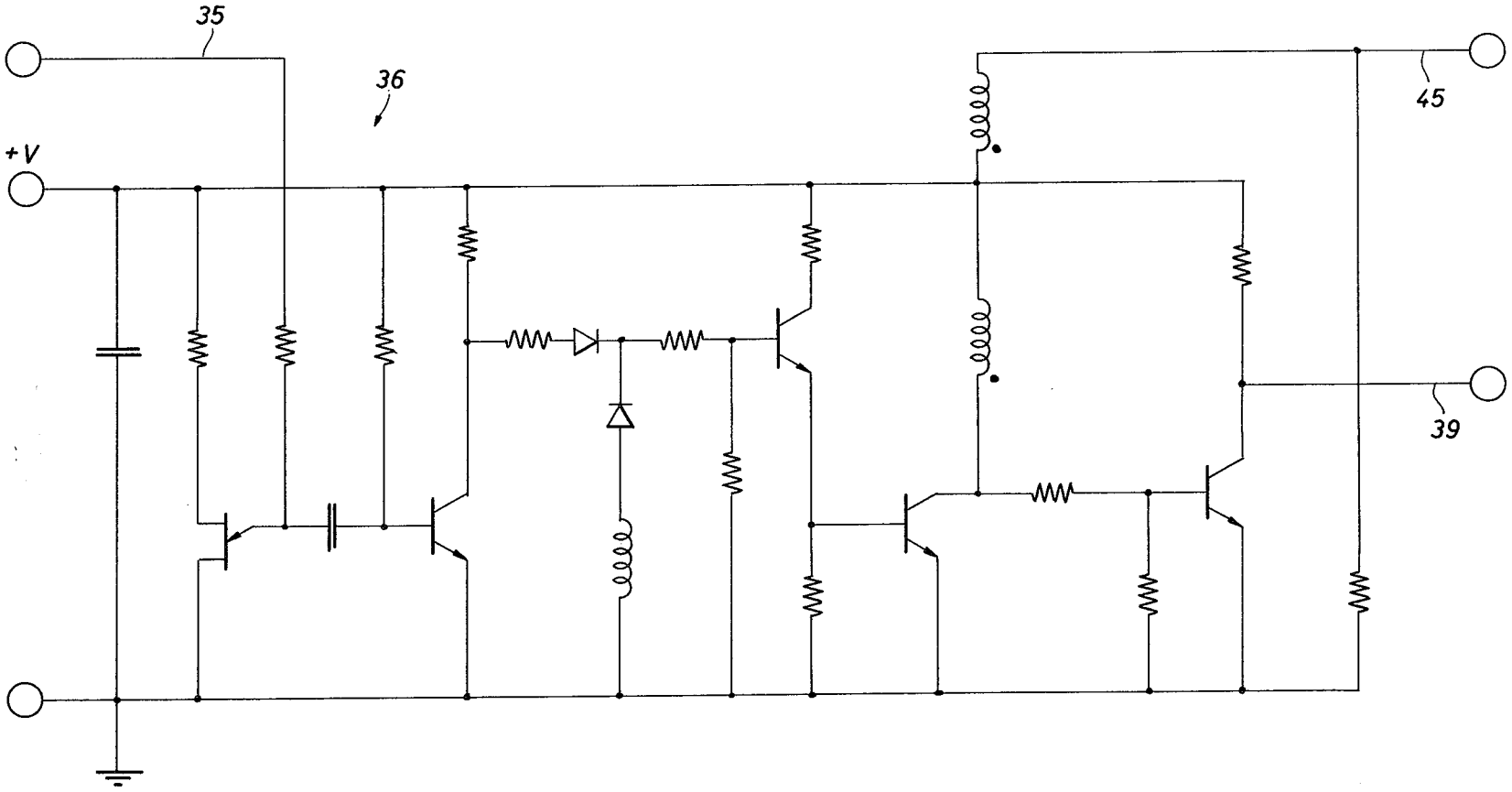
FIG. 5 shows the dot clock and period generator shown in FIG. 1.

The signal on the conductor 35 is input to the dot clock in FIG. 5. It is connected directly to the blocking oscillator 37. The oscillator 37 utilizes voltage flyback induced in the series of windings on a common core and thereby forms a pulse of suitable amplitude for the conductor 45. Only a small current is required to drive the solenoid 18. The dot signals are formed on the conductor 39 in synchronism with the solenoid driving signals.

Figure 6:
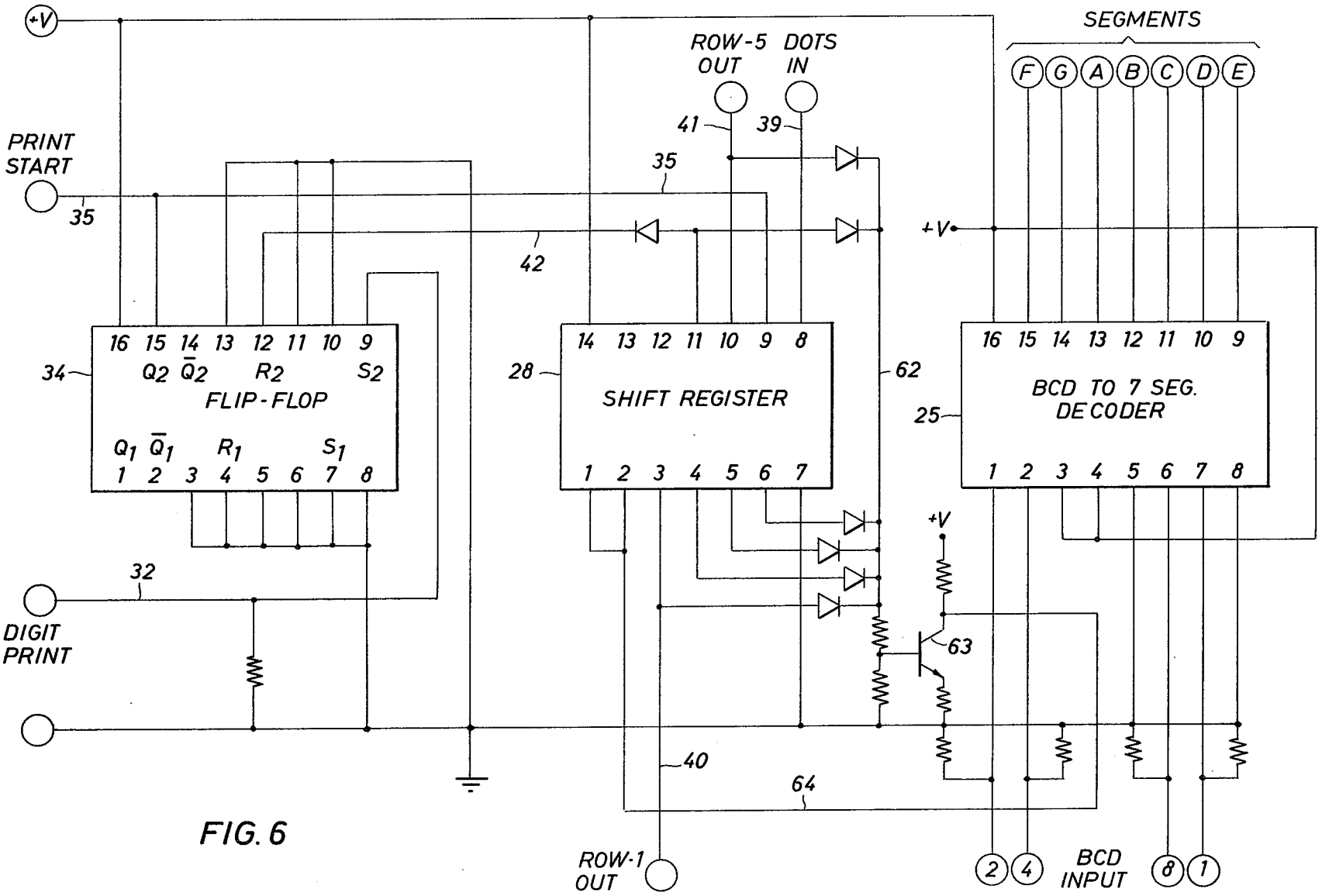
FIG. 6 is the block diagram of the BCD to seven segment decoder, a shift register for N integers, and a flip-flop.

In FIG. 6 of the drawings, the decoder 25 is shown. It is an integrated circuit, an exemplary circuit being a MC14511CP.

FIG. 6 further illustrates the shift register 28. The shift register 28 is preferably an integrated circuit, an exemplary circuit being MM74C164. The first row signal is output on the conductor 40. The fifth row is output on the conductor 41. Dots are input on the conductor 39. A reset signal for the flip flop 34 is formed on the conductor 42. It is triggered into operation by the signal on the conductor 35. A signal on the conductor 35 prepares the shift register and as dots occur (input on the conductor 39), the shift register shifts the stored value through the five rows. The conductor 42 is in actuality connected to the sixth position in the shift register to form a pulse serving as a reset for the flip flop 34. When the flip flop is provided with the signal on the conductor 42, it resets and causes the shift register to recycle through its operation beginning with the first dot position or a signal formed on conductor 40.

The apparatus indicates when each of the six row positions has been achieved forming an output pulse and they are all collectively summed on a conductor 62. The conductor 62 is input to a switching transistor 63 which forms a output signal on a conductor 64 which returns to the input of the shift register, thereby advancing the data in the shift register to complete the shift.

The flip flop 34 is also shown in FIG. 6 and a suitable integrated circuit is an MC14027.

Figure 9:
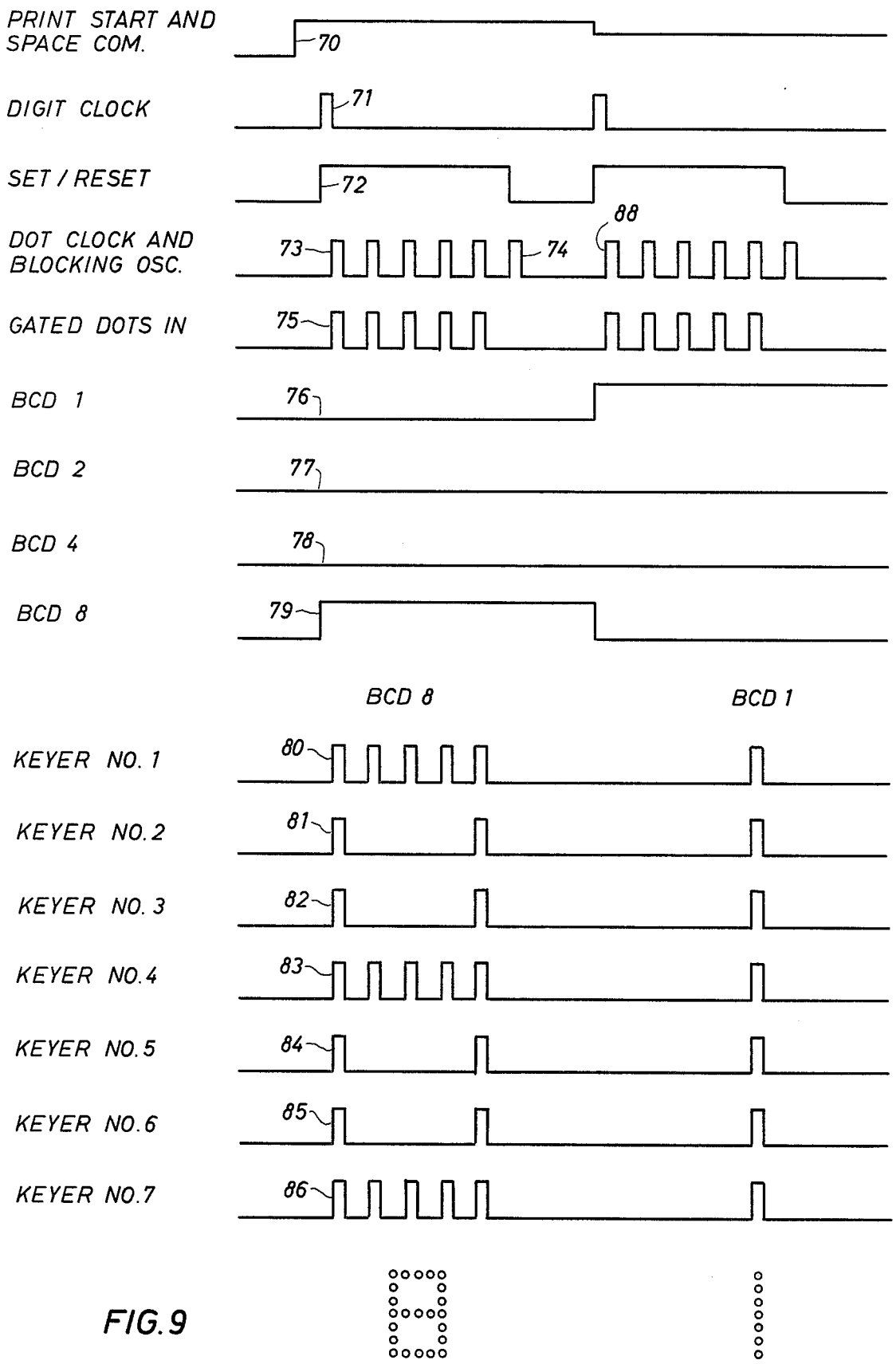
FIG. 9 is a timing chart showing the timing of the signals necessary to print an exemplary value.

Attention is next directed to FIG. 9 of the drawings. The timing chart will be described and its operation will be related to the printing of the number "81." When the switch 18 encounters the ticket, a signal wave form 70 is formed, referring to FIG. 9. This signal is input to the digital clock 31 which forms a fairly short pulse 71. The pulse is supplied on the conductor 32 to the flip flop 34. The flip flop 34 is toggled to form an output wave form 72. This signal is placed on the conductor 35 and activates the dot clock. The dot clock 36 forms a procession of pulses 73. Six pulses are formed although only five are printed. The sixth one is used in the shift register to terminate its operation. The sixth pulse is indicated by the numeral 74. In FIG. 9, the five dots are indicated by the numeral 75. When the sixth dot pulse 74 occurs, it is input to the shift register 28 and causes an output signal to be formed on the conductor 42 which resets the flip flop, forming the trailing edge of the wave form 72.

Assume for purposes of discussion that the signal on the conductor 32 to the multiplexer 24 indicates that the first binary coded digit is to be delivered, and that the value is eight. Accordingly, the multiplexer 24 operates to form the four signals necessary for the value of eight, and this is shown in the wave forms at form 76, 77, 78, and 79. The decoder 25 converts the four BCD signals into seven segments which are then input to the gates 26. The gates 26 form the sequence of five dots in syncronism with the dot clock, hence the first keyer forms dots 80 (FIG. 9) synchronized with the gated dots 75. The second keyer forms the dot pattern at 81. The third keyer forms the sequence of dots 82 while the fourth-seventh keyers form the dot patterns 83–86 inclusive.

On occurrence of the sixth dot 74, the flip flop 34 is toggled and a new pulse is formed on the conductor 35. The conductor 35 is connected to the dot clock 36 and a new burst of dots are formed at 88 which occur after the sixth dot pulse. The second digit shown in FIG. 9 has a value of one which is made up of the segments B and C and hence occupies the fifth dot position. It will be observed that the apparatus runs indefinitely until the paper ticket has passed fully through the equipment and the signal on the conductor 30 is changed thereby terminating operation of the digit clock. When it stops operation, the signal on the conductor 32 is stopped, and the multiplexer 24 does not advance any more data because there is no more paper for printing. In addition, the flip flop 34 does not receive the next reset. It remains in its quiescent condition until the next ticket is inserted.

Typically, the register 23 will be located in a remote piece of equipment. It sometimes is convenient to locate the multiplexer 24 remotely. If this is so, the conductor 32 must be extended to the multiplexer.

The foregoing is directed to the preferred embodiment but the scope of the present invention is determined by the claims which follow.

We claim:

1. A ticket printer apparatus for printing numbers on a ticket comprising:

a ticket transport mechanism for receiving a ticket therein;

a plurality of solenoid operated impact imprinters aligned relative to said ticket transport mechanism, said imprinters forming dots on a ticket in a pattern to form a visually readable number;

motor means for advancing the ticket to enable said imprinter to form dots sequentially on the ticket to define a number;

an input for receiving a sequence of numbers to be printed which numbers are supplied as electrically encoded values;

circuit means connected to said input means for forming a set of dot signals which signals are applied to said imprinters in timed sequence to form the number on the ticket out of a set of dots in an X by Y pattern to form dots therein selected by the signals; and power means furnishing power to said imprinters under control of said circuit means to operate said imprinters and which power means comprises a voltage flyback power source to drive said imprinters.

2. The apparatus of claim 1 wherein said circuit means is supplied with BCD signals, and includes a means converting the BCD's signals into seven segmental signals; a dot generator forming a dot procession; and gate means converting the seven segmental signals into timed dot signals applied to said imprinters.

3. The apparatus of claim 2 wherein said converting means includes a clock means forming timed signals which are sequentially spaced; and a plurality of gates, one for each dot imprinter, and each gate incorporates an input enable signal timed by said dot generator to form an output signal timed by said clock means and which dot imprints are physically spaced on a ticket and are printed thereon and confined within an X by Y rectangle.

4. The apparatus of claim 1 including a buffer for selectively storing N digits in memory, a multiplexer connected to said buffer for transferring a single digit therefrom to said input which digit is converted by said means into seven segmental signals for a specified interval, said multiplexer thereafter transferring a second digit from said buffer wherein N is an integer.

5. The apparatus of claim 4 wherein said multiplexer operates to transfer a digit by timed operation of a counter means which is provided with an input signal on occurance of each line of dots in the X by Y pattern.

6. The apparatus of claim 1 including a switch means sensing the presence of a ticket which forms an enable signal applied to a multiplexer for transfer of a succession of digits to be printed on the ticket, and said multiplexer is connected to a multidigit source.

* * * * *